US006289191B1

(12) United States Patent
Liu et al.

(10) Patent No.: US 6,289,191 B1
(45) Date of Patent: Sep. 11, 2001

(54) SINGLE PASS, MULTICOLOR CONTACT ELECTROSTATIC PRINTING SYSTEM

(75) Inventors: Chu-heng Liu, Penfield; Weizhong Zhao, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/449,994

(22) Filed: Nov. 26, 1999

(51) Int. Cl.[7] ..... G03G 15/10
(52) U.S. Cl. ..... 399/223; 55/233; 55/237
(58) Field of Search ..... 118/659, 660, 118/661, 662; 399/178, 179, 223, 226, 228, 299, 302, 306, 308

(56) References Cited

U.S. PATENT DOCUMENTS

| | | | |
|---|---|---|---|
| 3,729,419 | 4/1973 | Honjo et al. | 252/62.1 |
| 3,841,893 | 10/1974 | Honjo et al. | 117/37 LE |
| 3,847,478 | 11/1974 | Young . | |
| 3,968,044 | 7/1976 | Tamai et al. | 252/62.1 L |
| 4,476,210 | 10/1984 | Croucher et al. | 430/114 |
| 4,504,138 | 3/1985 | Kuehnle et al. . | |
| 4,707,429 | 11/1987 | Trout | 430/115 |
| 4,762,764 | 8/1988 | Ng et al. | 430/115 |
| 4,794,651 | 12/1988 | Landa et al. | 430/110 |
| 5,223,368 | 6/1993 | Ciccarelli et al. | 430/110 |
| 5,436,706 * | 7/1995 | Landa et al. | 399/223 |
| 5,451,483 | 9/1995 | Fuller et al. | 430/114 |
| 5,455,668 * | 10/1995 | De Bock et al. | 399/223 |
| 5,484,670 | 1/1996 | Angell et al. | 429/199 |
| 5,519,473 | 5/1996 | Morehouse, Jr. et al. . | |
| 5,596,396 | 1/1997 | Landa et al. | 399/237 |
| 5,610,694 | 3/1997 | Lior et al. | 399/240 |
| 5,619,313 * | 4/1997 | Domoto et al. | 399/233 |
| 5,740,493 * | 4/1998 | Otaki et al. | 399/71 |
| 5,826,147 | 10/1998 | Liu et al. | 399/237 |

FOREIGN PATENT DOCUMENTS

| | | |
|---|---|---|
| 0 756 213 A1 | 1/1997 | (EP) . |
| 0 887 716 A2 | 12/1998 | (EP) . |

* cited by examiner

*Primary Examiner*—Robert Beatty
*Assistant Examiner*—Hoang Ngo
(74) *Attorney, Agent, or Firm*—Mark Z. Dudley

(57) ABSTRACT

Imaging system for effecting single pass, multicolor printing of a color image, wherein the imaging system includes a plurality of contact electrostatic printing engines operable in serial fashion upon a copy substrate, wherein each contact electrostatic printing engine images and develops a respective electrostatic latent image representative of a component of the color image, and subsequently transfers the developed component image to the copy substrate as the copy substrate proceeds in a single pass through the imaging system.

25 Claims, 4 Drawing Sheets

SINGLE PASS, MULTICOLOR CONTACT ELECTROSTATIC PRINTING SYSTEM

FIELD OF THE INVENTION

This invention relates generally to electrostatic latent image development systems that operate using liquid developing material, and, more particularly, relates to a multicolor imaging system that employs contact electrostatic development of a series of latent images, wherein the latent images are representative of respective component images that are combinable to form a composite color image.

BACKGROUND OF THE INVENTION

A typical electrostatographic printing process includes a development step whereby developing material including toner or marking particles is physically transported into the vicinity of a latent image bearing imaging member, with the toner or marking particles being caused to migrate via electrical attraction of toner or marking particles to the image areas of the latent image so as to selectively adhere to the imaging member in an image-wise configuration. Various methods of developing a latent image have been described in the art of electrophotographic printing and copying systems. Of particular interest with respect to the present invention is the concept of forming a thin layer of liquid developing material on a first surface, wherein the layer has a high concentration of charged marking particles. The layer is brought into contact with an electrostatic latent image on another surface, wherein development of the latent image occurs upon separation of the first and second surfaces, as a function of the electric field strength generated by the latent image. In this process, toner particle migration or electrophoresis is replaced by direct surface-to-surface transfer of a toner layer induced by image-wise fields.

For the purposes of the present description, the concept of latent image development via direct surface-to-surface transfer of a toner layer via image-wise fields will be identified generally as contact electrostatic printing (CEP). Exemplary patents which may describe certain general aspects of contact electrostatic printing, as well as specific apparatus therefor, may be found in U.S. Pat. Nos. 4,504,138; 5,436,706; 5,596,396; 5,610,694; and 5,619,313.

Landa et al., in U.S. Pat. No. 5,436,706, disclose a multicolor system wherein a plurality of developer rollers are said to be provided, one for each color, which are sequentially engaged with a photoconductive surface to develop sequentially produced latent images.

Domoto et al., in U.S. Pat. No. 5,619,313, disclose a multicolor embodiment of a liquid electrophotographic simultaneous development and transfer apparatus that includes a continuous transfer belt. Four latent imaging units are positioned about the periphery of the transfer belt. Each latent imaging unit are said to be substantially identical to one another, except for the color of the liquid developer material employed therein.

SUMMARY OF THE INVENTION

In accordance with one aspect of the present invention, there is provided an imaging system for effecting single pass, multicolor printing of a color image, wherein the imaging system includes a plurality of contact electrostatic printing engines operable in serial fashion upon a copy substrate, wherein each contact electrostatic printing engine images and develops a respective electrostatic latent image representative of a component image of the color image, and subsequently transfers the developed component image to the copy substrate as the copy substrate proceeds in a single pass through the imaging system.

In accordance with another aspect of the present invention, the imaging system employs a plurality of contact electrostatic printing engines for imaging and development of a series of latent images, wherein the latent images are representative of respective component images that are combinable to form a composite color image. Each contact electrostatic printing engine includes a photosensitive imaging member which is rotated so as to transport the surface thereof in a process direction for implementing steps for charging and imagewise exposure of a light image corresponding to the desired component image. A second movable member in the form of a liquid developing material layer applicator is provided in combination with a liquid developing material supply apparatus. After the material layer is formed on the surface of the liquid developing material layer applicator, the material layer is brought into pressure contact with the latent image bearing surface of imaging member by transporting the material layer through a process nip formed by the operative engagement of the layer applicator and the imaging member. A development step then occurs, producing a developed image made up of selectively separated portions of the material layer on the surface of the material layer applicator, while leaving background image byproduct on the surface of the imaging member. Transfer of the developed image from the surface of the material layer applicator may then be accomplished. Accordingly, high-temperature and pressure transfer and/or transfix apparatus may be advantageously employed for carrying out the transfer step, which heretofore would be more difficult to achieve at the photoconductive surface of the imaging member.

In accordance with another aspect of the present invention, a first embodiment of a contact electrostatic printing engine operable in the imaging system provides a process nip formed by operative engagement of first and second movable members for positioning a thin layer of liquid developing material in pressure contact with the electrostatic latent which generates imagewise electric fields across the layer of liquid developing material in the process nip. The process nip is defined by a nip entrance and a nip exit, wherein the process nip and the nip entrance are operative to apply compressive stress forces on the layer of liquid developing material thereat, and the nip exit is operative to apply tensile stress forces to the layer of liquid developing material, causing imagewise separation of the layer of liquid developing material corresponding to the electrostatic latent image. The layer of liquid developing material is defined by a yield stress threshold in a range sufficient to allow the layer of liquid developing material to behave substantially as a solid at the nip entrance and in the nip, while allowing the layer of liquid developing material along the image-background boundary to behave substantially as a liquid at the nip exit.

In accordance with another aspect of the present invention, a second embodiment of a contact electrostatic printing engine operable in the imaging system includes an imaging member for receiving an electrostatic latent image. The imaging member includes a surface capable of supporting a layer of marking material which may be in the form of toner particles. An imagewise exposure device is also provided for generating the electrostatic latent image on the imaging member, wherein the electrostatic latent image includes image areas defined by a first charge voltage and non-image areas defined by a second charge voltage distinguishable from the first charge voltage. A marking material supply apparatus is also provided for depositing marking material on the surface of the imaging member to form a layer of marking material thereon adjacent the electrostatic latent image on the imaging member. In addition, a charge source is provided for selectively delivering charges to the layer in an image-wise manner responsive to the electrostatic latent image on the imaging member to form a secondary latent image in the marking material layer having image and non-image areas corresponding to the electrostatic latent image on said imaging member. A separator member is also provided for selectively separating portions of the layer of marking material in accordance with the secondary latent image in the layer of marking material to create a developed image corresponding to the secondary electrostatic latent image formed on said imaging member.

In accordance with another aspect of the present invention, a third embodiment of a contact electrostatic printing engine operable in the imaging system includes an imaging member for receiving an electrostatic latent image. The imaging member includes a surface capable of supporting a layer of marking material which may be in the form of toner particles. An imagewise exposure device is also provided for generating the electrostatic latent image on the imaging member, wherein the electrostatic latent image includes image areas defined by a first charge voltage and non-image areas defined by a second charge voltage distinguishable from the first charge voltage. A marking material supply apparatus is also provided for depositing marking material on the surface of the imaging member to form a layer of marking material thereon adjacent the electrostatic latent image on the imaging member. In addition, a charge source is provided for selectively delivering charges to the layer in a image-wise manner responsive to the electrostatic latent image on the imaging member to form a secondary latent image in the marking material layer having image and non-image areas corresponding to the electrostatic latent image on the imaging member. The layer of marking material on the electrostatic latent image bearing member is selectively charged in imagewise manner to create a secondary latent image, and means are provided for inducing air breakdown in the vicinity of the liquid developing material layer so as to create the secondary latent image. A separator member is also provided for selectively separating portions of the layer of marking material in accordance with the secondary latent image in the layer of marking material to create a developed image corresponding to the secondary electrostatic latent image formed on said imaging member.

BRIEF DESCRIPTION OF THE DRAWINGS

The foregoing and other aspects of the present invention will become apparent from the following description in conjunction with the accompanying drawings wherein like reference numerals have been used throughout to identify identical or similar elements.

DETAILED DESCRIPTION OF THE EMBODIMENTS

The present invention is directed to an electrostatic imaging system wherein latent image development is carried out via direct surface-to-surface transfer of a liquid developing material layer utilizing image-wise electrostatic forces to separate a layer of liquid developing material into image and non-image regions, regardless of where the layer of liquid developing material is formed prior to image separation or how the image separating electrostatic forces are generated. Although the following description will describe, by example, a system and process in accordance with the present invention incorporating a photosensitive imaging member, it will be understood that the present invention contemplates the use of various alternative imaging members as are well known in the art of electro-statographic printing, including, for example, but not limited to, non-photosensitive imaging members such as a dielectric charge retaining member of the type used in ionographic printing machines, or electroded substructures capable of generating charged latent images.

In the case of the liquid developing materials and their use in electrostatographic processes described herein, and in particular, contact electrostatic printing processes, the liquid developing material, in the form of a thin layer supported on a surface which is brought into pressure contact with a second surface in a development nip formed therebetween, is exposed to at least two stresses: a compressive stress in the nip as well as at the entrance thereof; and a tensile stress at the nip exit as the developed image is separated into image areas on one surface and background areas on the other surface. In order to optimize the resultant image quality, it is desirable that the toner layer have sufficient yield stress to allow the toner particles therein to maintain their integrity while being exposed to these particular stress forces. Thus, preselecting materials having a particular yield stress and selectively varying the yield stress of a given liquid developing material, can be particularly useful in defining operational parameters for optimization of the contact electrostatic printing process.

Additionally, the contact electrostatic printing process of the present invention may preferably include development of an electrostatic latent image on an image support using supply limited development techniques, i.e., the developing potential of the latent image is not typically exhausted after being initially developed.

Additionally, the contact electrostatic printing process of the present invention includes limited relative movement between toner particles during and after latent image development, wherein the relatively high solids content of the toner prevents toner particles from moving relative to each other.

Figure 1:
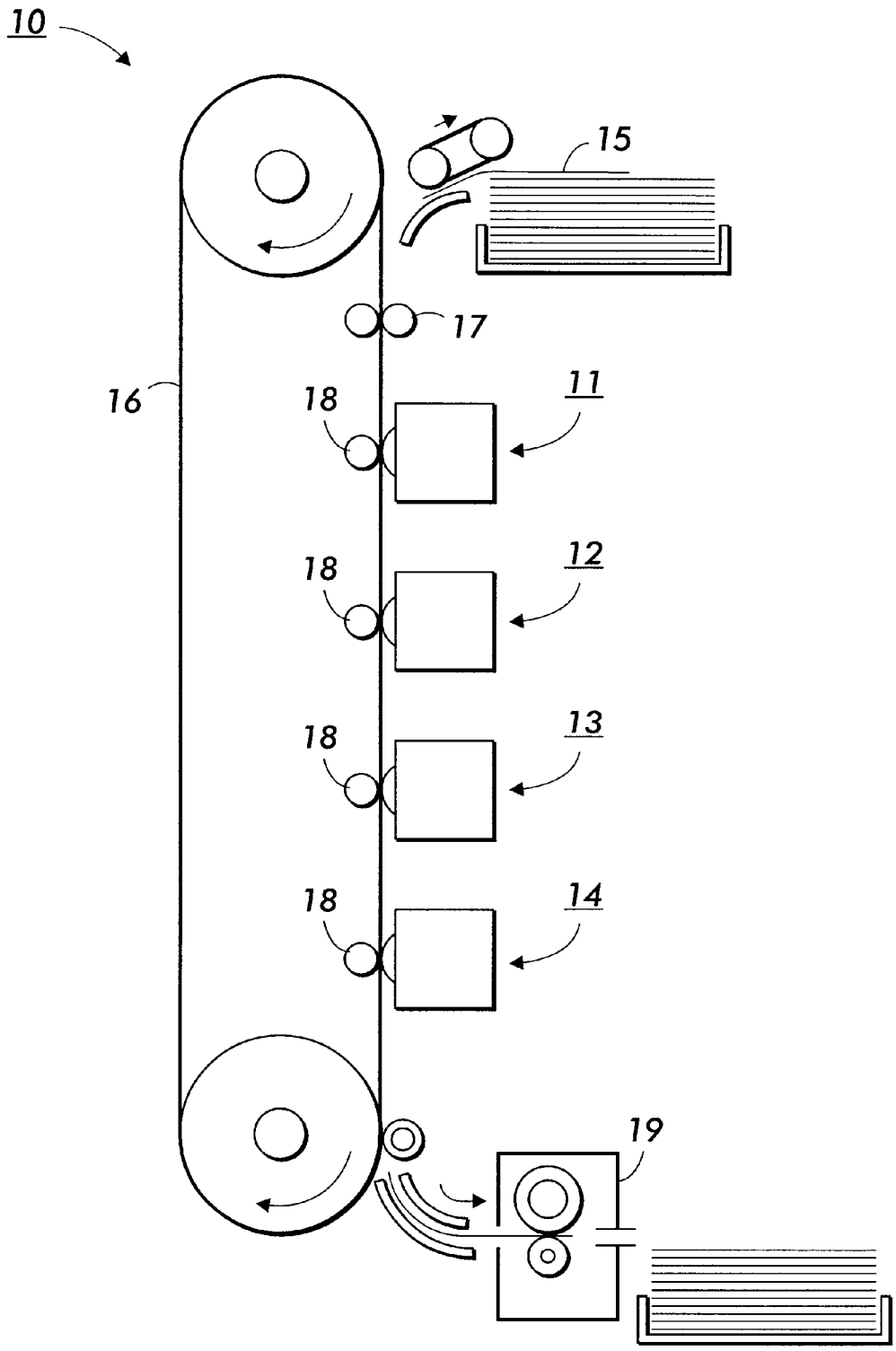
FIG.1 is a simplified schematic representation of a single pass, multicolor contact electrostatic printing (CEP) system constructed according to the present invention to include a serial arrangement of contact electrostatic printing engines, each of which are employed for imaging and developing a respective electrostatic latent image that corresponds to a component of the desired color image, wherein a layer of concentrated liquid developing material is used for development of the latent image, with subsequent separation and transfer of the developed image onto a copy substrate, thereby building a multicolor output image.

FIG. 1 is a simplified schematic representation of a single pass, multicolor contact electrostatic printing (CEP) system constructed according to the present invention to include a serial arrangement of contact electrostatic printing engines, each of which are employed for imaging and developing a respective component electrostatic latent image, wherein a layer of developing material is associated with the latent image for development and subsequent separation and transfer onto a copy substrate, thereby building a multicolor output image.

FIG. 1 accordingly illustrates an contact electrostatic printing system constructed and operative in accordance with the contact electrostatic printing process to which the present invention is directed, wherein a thin layer of relatively high toner solids content liquid developing material having a relatively high concentration of charged toner particles dispersed in the liquid carrier agent is brought into pressure contact with the entire surface of a latent image bearing imaging member, whereby the developed image is created by separating and selectively transferring portions of the liquid developing material layer in correspondence with the image and non-image regions of the latent image. The layer of high solids content liquid developing material is generally characterized as having a high solids content (e.g., approximately 10–50 percent solids, and preferably on the order of approximately 20 percent solids, or greater), wherein the solids content of the liquid developing material is made up of charged marking or toner particles.

The embodiment of a single pass, multicolor contact electrostatic printing system 10 illustrated in FIG. 1 a plurality of contact electrostatic printing engines 11, 12, 13, 14 which are adapted for serial linear operation with respect to a copy substrate 15 passed through a sheet pre-heater 17 and carried on a substrate transfer belt 16 Each engine is preferably associated with a respective pressure roller 80 for establishing at least a basic contact transfer, electrostatic transfer, or transfixing of the developed image to the copy substrate 15. An optional fuser assembly 19 is provided for full or final fusing of the composite image when necessary. Each engine 11, 12, 13, 14 includes a liquid developing material delivery system therein for transporting a layer of high solids content liquid developing material, or so called "toner cake", wherein the toner cake is separated into image and non-image segments. Image development occurs as a function of surface to surface transfer of an assemblage or aggregate of particles making up a particular section of the material layer as opposed to electrostatic attraction of individual toner particles dispersed in a carrier liquid. The toner cake has a high solids content and is brought into pressure contact with the surface of the imaging member, as will be described in detail below Preferably, the steps for imaging and development of the component images in each of the engines 11, 12, 13, 14 are effected for forming a multicolor composite image. The illustrated system 10 is thus operable for imaging and development of a series of color component images so as to provide a single pass, multicolor imaging and development system. Exemplary marking material colors in the respective developing materials are selectable has known in the art, e.g., cyan, magenta, yellow, and black; however, other component colors may be employed. It is contemplated that a contact electrostatic printing system having a lesser or greater number of engines may be constructed. Furthermore, the liquid developing material operable in each engine may be distinguishable according to one or more physical characteristics in addition to, or other than, the color of the marking material, and nonetheless such systems are encompassed by the present invention.

Figure 2:
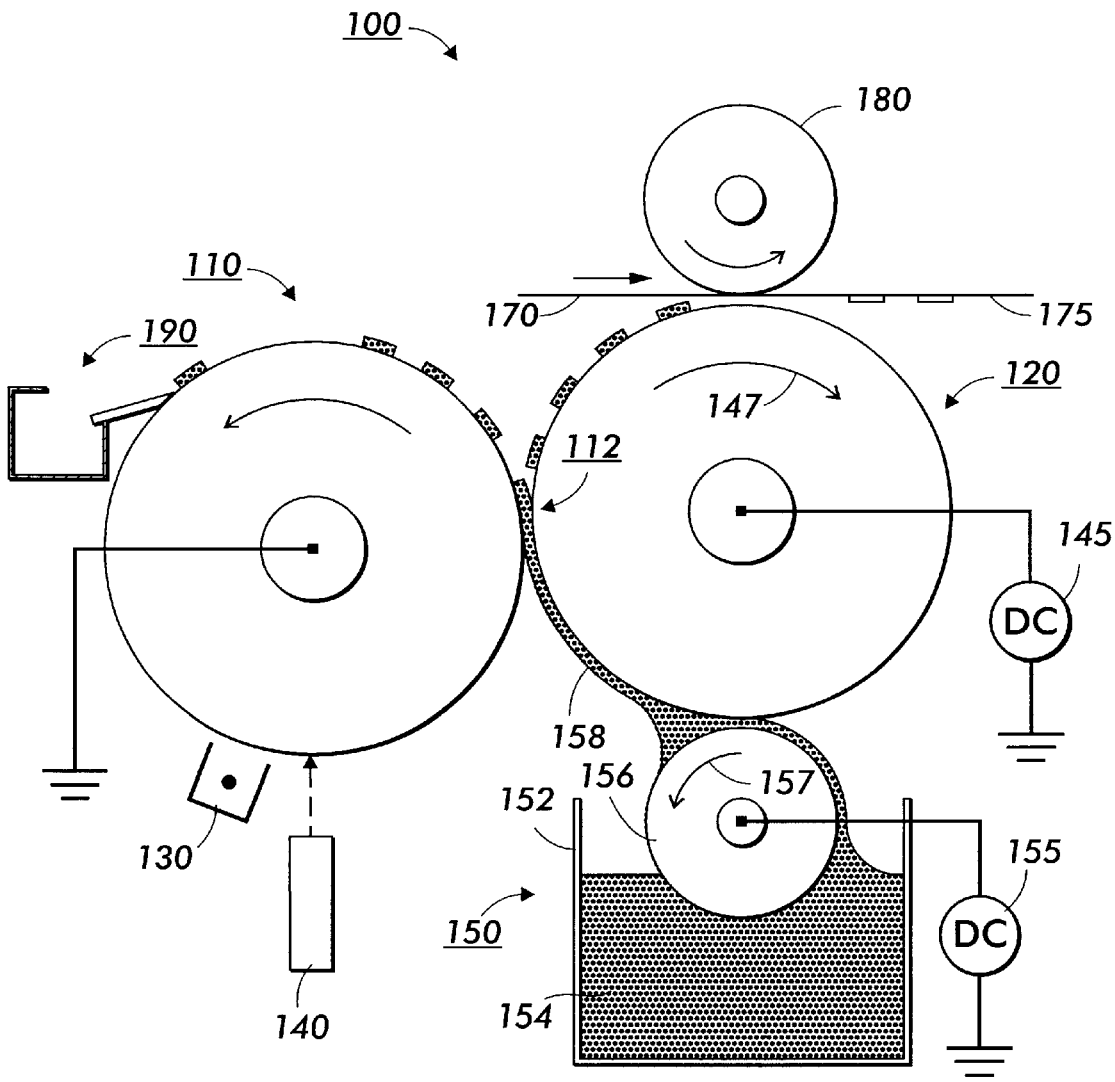
FIG. 2 is an elevational view schematically depicting a first embodiment of contact electrostatic printing engine constructed for use in the system of FIG. 1 for imaging and development of an component electrostatic latent image, wherein a layer of concentrated liquid developing material is placed in pressure contact with a latent image bearing surface for development of the latent image.

FIG. 2 is an elevational view schematically depicting a first embodiment 100 of contact electrostatic printing engine constructed for use in the system of FIG. 1 for imaging and development of a component electrostatic latent image, wherein a layer of concentrated liquid developing material is placed in pressure contact with a latent image bearing surface for development of the latent image.

The CEP engine 100 comprises a first movable member in the form of an imaging member 110 including an imaging surface of any type capable of having an electrostatic latent image formed thereon. An exemplary imaging member 110 may include a typical photoconductor or other photoreceptive component of the type known to those of skill in the art of electrophotography, wherein a surface layer 114 having photoconductive properties is supported on a conductive support substrate 116.

Imaging member 110 is rotated so as to transport the surface thereof in a process direction for implementing a series of image forming steps. It will be understood that, while imaging member 110 is shown and described herein in the form of a drum, the imaging member may alternatively be provided in the form of a continuous flexible belt which is entrained over a series of rollers, and is movable in the same direction as shown.

Initially, in the exemplary embodiment of FIG. 2, the photoconductive surface 114 of imaging member 110 passes through a charging station, which may include a corona generating device 130 or any other charging apparatus for applying an electrostatic charge to the surface of the imaging member 110. The corona generating device 130 is provided for charging the photoconductive surface 114 of imaging member 110 to a relatively high, substantially uniform electrical charge potential. It will be understood that various charging devices, such as charge rollers, charge brushes and the like, as well as inductive and semiconductive charge devices, among other devices which are well known in the art, may be utilized at the charging station for applying a charge potential to the surface of the photosensitive imaging member 110.

After the imaging member 110 is brought to a substantially uniform charge potential, the charged surface thereof is advanced to an image exposure station, identified generally by reference numeral 140. The image exposure station projects onto the charged photoconductive surface a light image corresponding to the desired component image. In the case of an imaging system having a photosensitive imaging member, the light image projected onto the surface of the imaging member 110 selectively dissipates the charge thereon for recording an electrostatic latent image on the photoconductive surface 114, wherein the electrostatic latent image comprises, in image configuration corresponding to the input image information, image areas defined by a first charge voltage potential and non-image areas defined by a second charge voltage potential. The image exposure station 140 may incorporate various optical image projection and formation components as are known in the art, and may include various well known light lens apparatus or digital scanning systems for forming and projecting an image from an original input document onto the imaging member 110. Alternatively, various other electronic devices available in the art may be utilized for generating electronic information to create the electrostatic latent image on the imaging member. It will be understood that the electrostatic latent image may be comprised of image and non-image areas that are defined by regions having opposite charge polarities or by regions having distinguishable first and second voltage potentials which are of the same charge polarity.

A second movable member in the form of a liquid developing material layer applicator 120 is provided in combination with a liquid developing material supply apparatus 150, including a reservoir 152 adapted to accommodate a supply of liquid developing material 154, generally made up of toner particles immersed in a liquid carrier material and also typically including a charge director for providing a mechanism for producing an electro-chemical reaction in the liquid developing material composition which generates the desired electrical charge on the toner particles. Generally, the liquid carrier medium is present in a large amount in the introductory supply of developing material 154. Initially, the liquid carrier medium is present in an amount of from about 90 to as much as 99.5 percent by weight, although the percentage amount may vary from this range provided that the objectives of the present invention are achieved.

A supply roller 156 is rotated in a direction as indicated by arrow 157 for transporting liquid developing material onto the surface of the liquid developing material layer applicator 120 which is preferably provided in the form of a relatively thin, substantially uniformly distributed material layer 158 made up of densely packed toner particles in a liquid carrier. Depending on the materials utilized in the liquid developing material composition 154, as well as other process parameters related to the printing system, such as process speed and the like, a layer of liquid developing material having sufficient thickness, preferably between 2 and 15 microns and more preferably on the order of 5 microns or less, may be formed on the surface of the liquid developing material layer applicator 120 by merely providing adequate proximity and/or contact pressure between the supply roller 156 and the roll surface of layer applicator 120. Alternatively, or additionally, an electrical biasing source 155 (255 in FIG. 3) may be coupled to the supply roller 156 to assist in electrostatically moving the toner particles onto the surface of the layer applicator 120. Thus, in one exemplary embodiment, the supply roller 156 can be coupled to an electrical biasing source 155 for implementing a so-called forward biasing scheme, wherein the supply roller 156 is provided with an electrical bias of sufficient magnitude and polarity for creating electrical fields extending from the supply roller 156 to the surface of the liquid developing material layer applicator 120. These electrical fields cause toner particles to be substantially uniformly transported to the surface of the liquid developing material layer applicator 150, for forming a layer of liquid developing material having a concentrated and substantially uniform distribution of toner particles therein.

It will be understood that other devices or apparatus may be utilized for applying the material layer 158 to the surface of the material layer applicator 120, including various well known apparatus used in conventional lithographic printing applications as well as traditional liquid electrostatographic applications, such as, but not limited to, the various known systems directed toward the transportation of liquid developing material having toner particles immersed in a carrier liquid. For example, the liquid transport system can include a fountain-type device as disclosed generally in commonly assigned U.S. Pat. No. 5,519,473 (incorporated by reference herein). A reverse roll member, situated adjacent to and downstream from the liquid developing material applicator, may also be provided. The function of the reverse roll member can be two-fold: for metering a portion of the liquid carrier away from the liquid developing material as it is applied to the surface of the layer applicator 120; and/or for electrostatically pushing (via biasing source 155) the liquid developing material toward the surface of the layer applicator 120.

After the material layer 158 is formed on the surface of the liquid developing material layer applicator 120, the material layer 158 is brought into pressure contact with the latent image bearing surface of imaging member 110 by transporting the material layer 158 through a process nip 112 formed by the operative engagement of the layer applicator 120 and the imaging member 110. (As noted above, the portion of the material layer 158 to be brought into pressure contact with the surface of imaging member 110 may be described as the toner cake, as it is characterized as a substantially high solids percentage composition of preferably greater than 20% by weight toner solids.)

It is important to note here that the present invention is dependent upon the solid-like property of the material layer in the process nip 112 such that the presence of hydrodynamic lift occurring in the nip, as disclosed in some prior art references noted hereinabove, is not applicable to the concepts of the present invention. One objective of the engine 100 illustrated in FIG. 2 is to place the material layer under pressure in the process nip 112; accordingly, it may desirable to provide either the layer applicator 120 or the imaging member 110 in the form of a conformable member for permitting the surface of one member to correspond on form or character to the opposing surface in the nip region. When the surface of the applicator 120 bearing the material layer 158 is engaged with the latent image bearing photoconductive surface 114 of imaging member 110, the material layer 158 is substantially uniformly distributed within the nip created therebetween such that toner particle motion and/or liquid flow is negligible with no distortion being present or induced between the toner particles in the material layer 158.

It will be understood that the presence of the latent image on the imaging member 110 may generate some fringe fields in areas of interface between image and non-image areas of the latent image. However, compared to conventional development, the present invention will substantially eliminate fringe field related image defects due to the solid-like property of the material layer 158 at the entrance of the nip.

An electrical biasing source 145 is coupled to the liquid developing material layer applicator 120 for applying an electrical bias thereto so as to generate electrostatic fields between the surface of layer applicator 120 and the image or non-image areas on the surface of the imaging member 110. These electrostatic fields generate fields in opposite directions, either toward the surface of the imaging member 110 or towards the surface of the layer applicator 120 in accordance with image and non-image portions of the latent image. Moreover, these fields cause the separation of the image and non-image areas of the material layer 158 upon separation of the imaging member 110 and the layer applicator 120 at the nip exit for simultaneously separating and developing the material layer 158 into image and non-image portions on the opposed surfaces of the imaging member 110 and the layer applicator 120. The liquid developing material layer applicator 120 may be biased so as to repel image areas, thereby producing a developed image made up of selectively separated and transferred portions of the material layer 158 on the surface of the imaging member 110, while leaving background image byproduct on the surface of the material layer applicator 120. The material layer applicator 120 is preferably electrically biased to be at a voltage intermediate the voltage potential of the exposed and unexposed portions of the electrostatic latent image on the imaging member 110.

Development occurs with substantially reduced movement of the toner particles. The development can therefore be implemented at an increased rate to allow high speed processing and improved throughput rates.

The resultant image/background separation is illustrated in the CEP engine 200 of FIG. 2. As shown, the material layer applicator 120 is provided with an electrical bias appropriate for attracting image areas while repelling image areas toward the imaging member 110, thereby maintaining toner portions corresponding to non-image areas on the surface of the liquid developing material layer applicator 120, yielding a developed image on the layer application.

The pressure applied between the imaging member 110 and liquid developing material layer applicator 120 is sufficient to result in the preferred thickness of the layer of developing material in the process nip 112. This layer of liquid developing material in the process nip 112, and therefore the process nip gap between the imaging member 110 and the materials layer applicator 120, is preferably less than 15 microns and more preferably less than 5 microns. The layer of liquid developing can have a thickness of about 1 micron and still produce acceptable print quality. The preferred process nip gap of less than 5 microns enables development of images of greater than 800 dots per inch (dpi).

This layer of liquid developing material is exposed to at least two very different and opposed stress forces as it is transported into, through and out of the process nip. As the material layer 158 enters the process nip 112 and travels therethrough, compressive stress forces are generated and exerted upon the material layer 158. Thereafter, as the toner layer exits the process nip 112 and the material layer 158 is separated into image and background areas on the opposed surfaces of the imaging member 110 and the material layer applicator 120, tensile stress forces are generated and exerted upon the toner layer 158.

Image quality is dependent on the ability of the material layer 158, and in particular, the toner particles therein, to maintain their integrity as an assemblage of toner particles such that lateral movement of the toner particles is prevented when the liquid developing material layer is exposed to compression stress forces, thereby allowing the toner particles to maintain their initial distribution and density levels as the liquid developing material layer 158 enters the nip 112, and further allowing the toner particles of the liquid developing material layer 158 to sustain an image pattern as it passes through the nip. At the exit, the toner patch in the image area will stay with one surface and the toner patch in the background area will stay with another surface according to the image-wise electrical field. In addition, image quality is further dependent on the ability of the toner particles in the liquid developing material layer 158 to break sharply along the image-background boundary where the electrostatic force is substantially zero. Thus, it is desired for the liquid developing material layer 158 to attain a shear tensile yield stress which is substantially lower than the stress induced by the electric fields at the exit of the nip 112 for preventing image quality degradation when the liquid developing material layer is exposed to tensile stress forces at the nip exit while separating into image and non-image regions on opposed surfaces. In the process nip 112, the toner particles are attracted in an image-wise fashion toward the surface of the imaging member 110 or the material layer applicator 120. The toner particles are required to migrate a relatively small distance, therefore allowing for increased process speeds.

The toner particles are required to migrate less than one half the width or gap of the process nip 112. As a result of the small toner migration, the image areas and background are interspersed due to each extending from the respective surfaces of the imaging member 110 and material layer applicator 120 more than one half of the gap of the process nip 112. The thickness of each of the toner layers of the background and the image area are therefore greater than one half the gap of the process nip 112. The spaces in the process nip from which the toner migrates continue to be occupied by carrier fluid. As a result of the relatively small toner migration, the toner layer of the background and the toner layer of the developed image are in substantial contact. There is as a result, edge to edge contact of the opposed toner layers in the process nip 112.

The developed image and background are separated at the exit of the process nip 112. The interspersed and contacting developed image area and background toner layers break or snap cleanly at the edge to edge contact. The clean breaking of the edge to edge contact provides for improved edge definition of the developed image relative to prior development systems.

In the illustrated embodiment, continued rotation of material applicator 120 allows the developed image to be transferred from the surface of the image member 110 to a copy substrate 175 carried on the substrate transfer belt 170.

Figure 3:
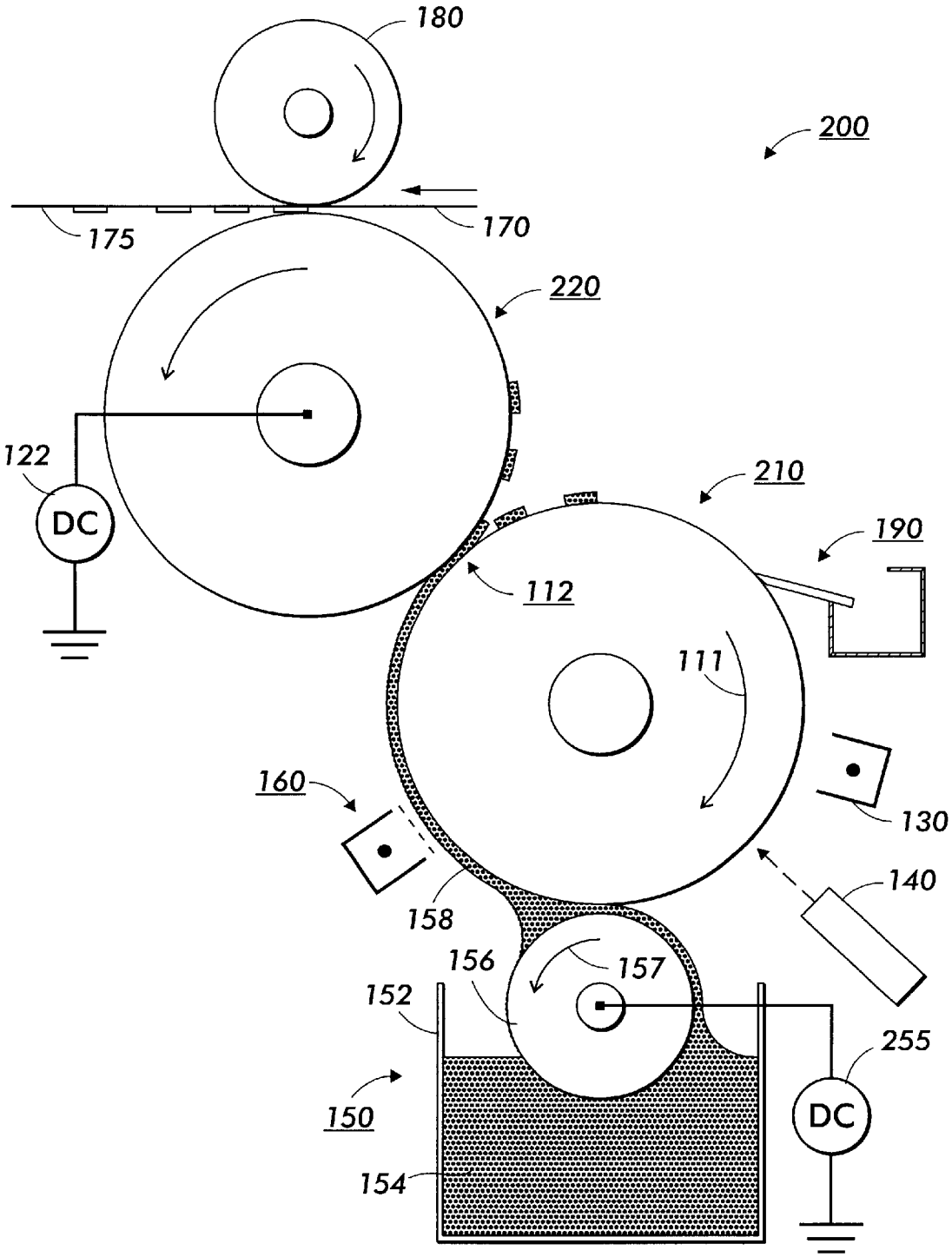
FIG. 3 is an elevational view schematically depicting a second embodiment of a CEP engine constructed for use in the system of FIG. 1 for imaging and development of an component electrostatic latent image, wherein a layer of concentrated liquid developing material on an electrostatic latent image bearing member is selectively charged in imagewise manner to create a secondary latent image.

FIG. 3 is an elevational view schematically depicting a second embodiment 200 of a CEP engine constructed for use in the system of FIG. 1 for imaging and development of an component electrostatic latent image, wherein a layer of liquid developing material on an electrostatic latent image bearing member is selectively charged in imagewise manner to create a secondary latent image.

As illustrated in FIG. 3, the second embodiment 200 of a contact electrostatic printing engine may be constructed for operation in a fashion similar to that described hereinabove with respect to the first embodiment 100 of a contact electrostatic printing engine, but adapted for the formation of a secondary latent image in the toner layer, as will now be described. After the material layer 158 is formed on the surface of an electrostatic latent image bearing member 210, the material layer 158 is charged in an image-wise manner. After the imaging member 210 is brought to a substantially uniform charge potential by the corona generating device spacebar 130, the charged surface thereof is advanced to an image exposure station, identified generally by reference numeral 140. An ion source 160 (represented schematically in FIG. 3 as a scorotron device) is provided for introducing free mobile ions in the vicinity of the charged latent image to facilitate the formation of an image-wise ion stream extending from the source 160 to the latent image on the surface of the image bearing member 210. The image-wise ion stream generates a secondary latent image in the toner layer made up of oppositely charged toner particles in image configuration corresponding to the latent image.

The function of the ion source 160 is to charge the toner layer 158 in an image-wise manner. This process will be described with respect to a negatively charged toner layer, although it will be understood that the process can also be implemented using a positively charged toner layer. In addition, the process of the present invention can also be implemented using an uncharged or neutral toner layer.

The initially charged toner cake 158 is thus considered, for purposes of simplicity only, as a uniformly distributed layer of negatively charged toner particles having the thickness of a single toner particle. The toner cake resides on the surface of the image bearing member 210 which is being transported from left to right past the broad source ion source 160. As previously described, the primary function of the broad source ion source 160 is to provide free mobile ions in the vicinity of the image bearing member 210 having the toner layer and latent image thereon. As such, the broad source ion device may be embodied as various known devices, including, but not limited to, any of the variously known corona generating devices available in the art, as well as charging roll type devices, solid state charge devices and electron or ion sources analogous to the type commonly associated with ionographic writing processes.

The preferred ion source 160 includes a corona generating electrode enclosed within a shield member surrounding an electrode on three sides. A wire grid covers the open side of the shield member facing the image bearing member 210. In operation, the corona generating electrode, otherwise known as a coronode, is coupled to an electrical biasing source capable of providing a relatively high voltage potential to the coronode, which causes electrostatic fields to develop between the coronode and the grid and the image bearing member 210. The force of these fields causes the air immediately surrounding the coronode to become ionized, generating free mobile ions which are repelled from the coronode toward the grid and the image bearing member 210. The scorotron grid is biased so as to be operative to control the amount of charge and the charge uniformity applied to the imaging surface of the image bearing member 210 by controlling the flow of ions through the electrical field formed between the grid and the imaging surface.

Accordingly, the ion source 160 is operated to provide ions having a charge opposite the toner layer charge polarity. Thus, in the case of a negatively charged material layer 158, the ion source 160 is preferably provided with an energizing bias at its grid intermediate the potential of the image and non-image areas of the latent image on the image bearing member 210. In areas where the latent image is at a potential lower than the bias potential of the charging source grid, the bias potential generates electrostatic field lines in a direction toward the image bearing member 210 and material layer 158. Conversely, electrostatic field lines are generated in a direction away from the image bearing member 210 and material layer 158 in areas where the latent image is at a potential higher than the bias potential of the charging source grid. The free flowing ions generated by the ion source 160 are captured by material layer 158 in a manner corresponding to the latent image on the image bearing member 210, causing image-wise charging of the material layer 158, thereby creating a secondary latent image within the material layer 158 that is charged opposite in charge polarity to the charge of the original latent image. Under optimum conditions, the charge associated with the original latent image will be captured and converted into the secondary latent image in the material layer 158 such that the original electrostatic latent image is substantially or completely dissipated into the material layer 158.

Once the secondary latent image is formed in the material layer 158, the secondary latent image bearing portion of the material layer is advanced to an image separator 220. Image separator 220 may be provided in the form of a biased roll member having a surface adjacent to the surface of the image bearing member 210 and preferably contacting the material layer 158 residing on image bearing member 210. An electrical biasing source 122 is coupled to the image separator 220 to bias the image separator 220 so as to attract either image or non-image areas of the latent image formed in the material layer 158 for simultaneously separating and developing the material layer 158 into image and non-image portions. The image separator 220 is biased with a polarity opposite the charge polarity of the image areas in the material layer 158 for attracting image areas therefrom, thereby producing a developed image made up of selectively separated and transferred portions of the toner cake on the surface of the image separator 220, while leaving background image byproduct on the photosensitive surface of the image bearing member 210.

After the developed image is formed on the surface of the imaging separator 220, the developed image may then be transferred to a copy substrate. In the illustrated embodiment, the developed image is transferred from the surface of the imaging separator 220 to a copy substrate 175 carried on the transfer belt 170.

Additional details of the construction and operation of the illustrated embodiment 200 of the CEP engine and variations thereof may be found in commonly-assigned U.S. Pat. No. 5,826,147, the disclosure of which is incorporated herein by reference.

Figure 4:
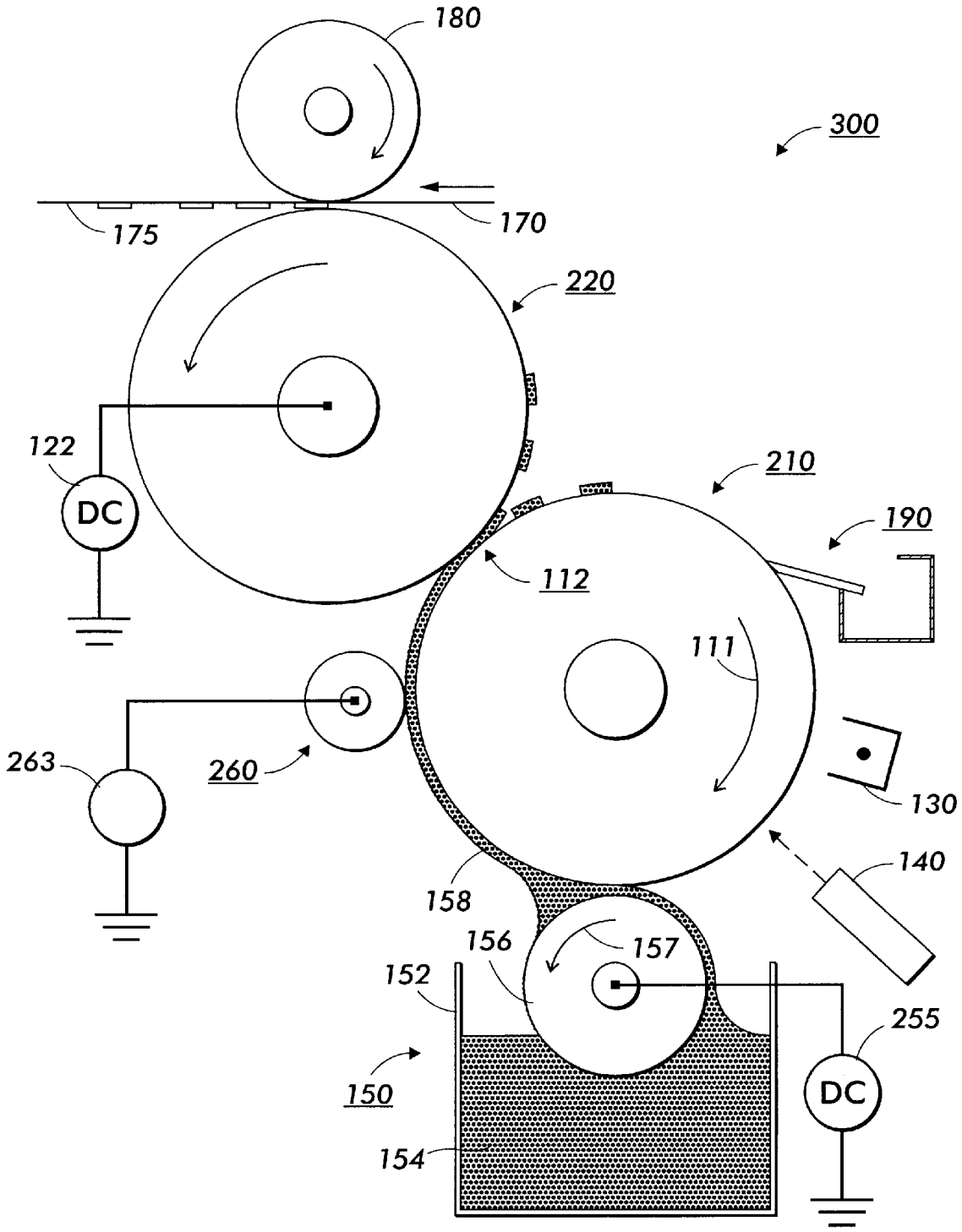
FIG. 4 is an elevational view schematically depicting a third embodiment of a CEP engine constructed for use in the system of FIG. 1 for imaging and development of an component electrostatic latent image, wherein a layer of concentrated liquid developing material on an electrostatic latent image bearing member is selectively charged in imagewise manner to create a secondary latent image, and wherein means are provided for inducing air breakdown in the vicinity of the liquid developing material layer so as to create the secondary latent image.

FIG. 4 is an elevational view schematically depicting a third embodiment 300 of a CEP engine constructed for use in the system of FIG. 1 for imaging and development of a component electrostatic latent image, wherein a layer of liquid developing material on an electrostatic latent image bearing member is selectively charged in imagewise manner to create a secondary latent image, and wherein means are provided for inducing air breakdown in the vicinity of the liquid developing material layer so as to better create the secondary latent image.

As illustrated in FIG. 4, the third embodiment 300 of a contact electrostatic printing engine may be constructed for operation similar to that described hereinabove with respect to the second embodiment 200, and wherein means are provided for inducing air breakdown in the vicinity of the liquid developing material layer so as to create the secondary latent image, as will now be described.

When two conductors are made proximate with a voltage applied their between, electrical discharge will occur as the voltage is increased to the point of air breakdown. Thus, at a critical threshold voltage, a discharge current occurs in the air gap between the conductors. This critical point is commonly known as the Paschen threshold voltage. When such conductors have a minimal gap (e.g., a few thousandths of an inch), the discharge can occur without arcing, such that a discharge current will be caused to flow across the gap.

As previously described, the primary function of the broad source ion charging device 160 is to provide free mobile ions in the vicinity of the image bearing member 210 having the material layer 158 and latent image so as to induce image-wise charging. A biased roll member 260 is coupled to an electrical biasing source 263 capable of providing a voltage potential to the roll member 260 that is sufficient to produce air breakdown in the vicinity of the latent image on the image bearing member 210. Preferably, the voltage applied to the roll 260 is maintained at a predetermined potential such that electrical discharge is induced only in a limited region where the surface of the roll member 260 and the image bearing member 210 are in very close proximity and the voltage differential between the roll member 260 and the image and/or non-image areas of the latent image exceed the Paschen threshold voltage. To effect that which will be known as "one-way breakdown", it is contemplated that the bias applied to the roll member 260 is sufficient to exceed the Paschen threshold voltage only with respect to either one of the image or non-image areas of the original latent image on the imaging member. Alternatively, to effect that which will be known as "to-way breakdown", the bias applied to the roll member 260 may be sufficient to exceed the Paschen threshold with respect to both the image or non-image areas of the original latent image. The air breakdown induced in these situations will can be caused to occur in a manner such that field lines are generated in opposite directions with respect to the image and non-image areas.

For example, in the case where the Paschen threshold voltage is about 400 volts, and the image and non-image areas have voltage potentials of about 0 and −1200 volts respectively, a bias potential applied to roll member 260 of approximately −200 volts will result in air breakdown that generates charges only in the region of the non-image areas such that the toner particles adjacent to this region will be effected. Conversely, a bias of −1000 volts applied to roll member 260, for example, will result in charge generation in the region of the image area of the latent image, with ions flowing in the opposite direction. In yet another alternative, a bias of approximately −600 volts applied to roll member 260 will result in charge generation in the areas adjacent both image and non-image areas with ions flowing in opposite directions. In this so-called 2-way air breakdown mode, electrical discharge via air breakdown is induced in a pre-nip region immediately prior to a nip region created by contact between the image bearing member 210 and the roll member 260. The electrical discharge causes electrostatic fields to develop between the roll member 260 and the image bearing member 210 in the pre-nip region. In turn, the force of these fields causes the air to become ionized, generating free mobile ions which are directed toward the image bearing member 210. The magnitude of the bias potential applied to the roll member 260 operates to control the image-wise ionization and the amount of charge and the charge uniformity applied to the imaging surface on the image bearing member 210. Thus, in accordance with the example described above, 2-way breakdown can be induced by applying a bias voltage to roll member 260 which is sufficient to exceed the Paschen threshold with respect to both image and non-image areas of a latent image on an imaging member brought into the vicinity of the roll member 260. Providing that this bias is applied to roll member 260 in a range intermediate to the potential associated with the image and non-image areas, there is proper control of the direction of charge flow for creating the desired secondary latent image in the material layer 158.

Accordingly, the image-wise charging of a neutrally charged toner cake can induce air breakdown in both the pre-nip and post-nip regions to provide the opposite charge polarity ions required to appropriately image-wise charge the neutral toner cake. Such charging can be enabled by a segmented version of the bias roll member 260, as disclosed generally in U.S. Pat. No. 3,847,478, the disclosure of which is incorporated by reference herein. Space bar It will be recognized that the bias voltage applied to the roll member 260 is not required to be intermediate the potentials associated with the image and non-image areas of the original latent image on the imaging member. Rather, a voltage which causes air breakdown relative to only one of either the image or non-image areas need be applied to the roll member.

Additional details of the construction and operation of the illustrated embodiment 300 of a contact electrostatic printing engine, and variations thereof, may be found in commonly-assigned U.S. Pat. No. 5,937,243, the disclosure of which is incorporated herein by reference.

As illustrated in FIGS. 2–4, after the developed image is created at the exit of the nip, such developed image is available for transfer to a copy substrate. In the illustrated embodiments, a copy substrate 175 such as a paper sheet may be aligned on the substrate belt 170 to receive such a transfer. Developed image transfer may be effected via selectable means known in the art, in accordance with the registration requirements of the composite color image, such as an electrostatic transfer apparatus including a corona generating device or a biased transfer roll. In yet another alternative, image transfer can be accomplished via surface energy differentials wherein the surface energy between the image and the member supporting the image prior to transfer is lower than the surface energy between the image and the copy substrate, inducing transfer thereto.

Preferably, a pressure transfer roll system is employed to tack the developed image to the copy substrate 175; which may include a heating and/or chemical application device for assisting in the pressure transfer and fixing of the developed image on the output copy substrate. In the embodiments shown in FIGS. 2–4, the developed image is preferably transferred to a copy substrate 175 via a heated pressure roll 180, whereby pressure and heat are simultaneously applied to the developed image to simultaneously transfer and at least partially fuse (e.g., transfuse) the developed image to the copy substrate 175.

In a final step in the operation of the embodiments of the CEP engines, the background image is removed in order to clean the surface in preparation for a subsequent imaging cycle. FIGS. 2–4 illustrate a simple blade cleaning apparatus 190 as is known in the art. Alternative embodiments may include a brush or roller member for removing toner from the surface on which it resides. The removed toner associated with the background image is transported to a toner sump or other reclaim vessel so that the waste toner can be recycled and used again to generate another material layer 158 in subsequent imaging cycles.

It will be understood that the liquid developing material supply apparatus 150 may include ancillary apparatus, such as a metering roll situated in close proximity to the surface of the imaging member 110, preferably rotated in a direction opposite to the direction of movement of the imaging member 110 or image bearing member 210, providing a shear force against the material layer deposited on the surface thereof, for controlling the thickness of the material layer. Thus, a metering roll may optionally be employed to meter a predetermined amount of liquid developing material (which may include toner particles immersed in liquid carrier). The excess material eventually falls away from the metering roll and may be transported to a sump (not shown) for reuse in the liquid developing material applicator 150. The liquid developing material layer applicator can also be used to remove image background areas from the liquid developing material layer 158.

The liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and N, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe. These particular hydrocarbons may also possess a sufficiently high vapor pressure so that a thin film of the liquid evaporates from the contacting surface within seconds at ambient temperatures.

Preferably, the material layer 158 achieves low enough yield stress to substantially eliminate lateral movement of the toner particles in the liquid developing material layer 158 when exposed to compression stresses generated at the entrance to and in the nip 112, while also having sufficient yield stress to permit the toner layer to act as a liquid in the presence of tensile stress forces present in the vicinity of the exit of the nip. Further definition of operational parameters for such optimization of the contact electrostatic printing process, via preselecting materials having a particular yield stress and/or selectively varying the yield stress of a given liquid developing material, may be determined by those skilled in the art so as to preselect the materials making up the liquid developing material, the toner particle concentration of the liquid developing material, and the electrical field strength generated between the biased layer applicator on one surface and the electrostatic latent image on a second surface.

The toner particles or so-called marking particles can comprise any particulate material that is compatible with the liquid carrier medium, such as those contained in the liquid developing materials disclosed in, for example, U.S. Pat. Nos. 3,729,419; 3,841,893; 3,968,044; 4,476,210; 4,707,429; 4,762,764; 4,794,651; and 5,451,483, among others. Preferably, the toner particles should have an average particle diameter ranging from about 0.2 to about 10 microns, and most preferably between about 0.5 and about 2 microns. The toner particles may be present in amounts of from about 5 to about 20 percent by weight, and preferably from about 1 to about 4 percent by weight of the developer composition. The toner particles can consist solely of pigment particles, or may comprise a resin and a pigment; a resin and a dye; or a resin, a pigment, and a dye or resin alone.

Suitable resins include poly(ethyl acrylate-co-vinyl pyrrolidone), poly(N-vinyl-2-pyrrolidone), and the like, including, for example Elvax®, and/or Nucrel®, available from E. I. DuPont de Nemours & Co. of Wilmington, Del. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers; as well as the numerous pigments listed and illustrated in U.S. Pat. Nos. 5,223,368; 5,484,670, the disclosures of which are totally incorporated herein by reference. Dyes generally are present in an amount of from about 5 to about 30 percent by weight of the toner particle, although other amounts may be present provided that the objectives of the present invention are achieved.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF); as well as the numerous pigments listed and illustrated in U.S. Pat. Nos. 5,223,368; 5,484,670, the disclosures of which are incorporated herein by reference. Generally, any pigment material is suitable provided that it consists of small particles that combine well with any polymeric material also included in the developer composition. Pigment particles are generally present in amounts of from about 5 to about 60 percent by weight of the toner particles, and preferably from about 10 to about 30 percent by weight.

As previously indicated, in addition to the liquid carrier vehicle and toner particles which typically make up the liquid developer materials, a charge director (sometimes referred to as a charge control additive) is also provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight of solids, and preferably from about 0.02 to about 0.05 percent by weight of solids of the developer composition.

What is claimed is:

1. An imaging system for effecting single-pass, multicolor printing of a color image, comprising:

a plurality of contact electrostatic printing engines operable in serial fashion upon a copy substrate, wherein each contact electrostatic printing engine includes an assembly for imaging and developing a respective electrostatic latent image representative of a component of the color image, and an assembly for subsequently transferring the developed component image to the copy substrate as the copy substrate proceeds in a single pass through the imaging system;

wherein at least one of the contact electrostatic printing engines further comprises:

a first movable member for having an electrostatic latent image formed thereon including image areas defined by a first voltage potential and non-image areas defined by a second voltage potential;

a second movable member for having a layer of liquid developing material coated thereon comprising toner particles and a liquid carrier; and a process nip formed by operative engagement of said first movable member and said second movable member for positioning the layer of liquid developing material in pressure contact with said first movable member, wherein the electrostatic latent image on said first member generates imagewise electric fields across the layer of liquid developing material in said process nip;

said process nip being defined by a nip entrance and a nip exit, and having a preestablished nip gap, said developing material developed in said nip gap to have imagewise separation of the liquid developing material to create a developed image corresponding to the electrostatic latent image and a background image, said developed image and said background image each having a thickness greater than one half the nip gap.

2. The imaging system of claim 1 wherein the layer of liquid developing material is defined by a yield stress threshold in a range sufficient to allow the layer of liquid developing material to behave substantially as a solid at the nip entrance and in the nip gap, while allowing the layer of liquid developing material to behave substantially as a liquid along the image/background interfaces at the nip exit.

3. The imaging system of claim 1, wherein the yield stress threshold of the layer of liquid developing material is sufficient to prevent lateral movement of toner particles therein in presence of the compressive stress forces exerted at the nip and nip entrance, and the yield stress threshold is sufficient to permit lateral movement of the toner particles therein in presence of the tensile stress forces exerted at the nip exit.

4. The imaging system of claim 1, wherein said first member includes a photosensitive imaging substrate.

5. The imaging system of claim 1, further including a liquid developing material supply apparatus adapted to deposit the layer of liquid developing material on a surface associated with said second member.

6. The imaging system of claim 1, wherein said liquid developing material layer has a thickness of approximately 2 to 15 microns in the nip gap.

7. The imaging system of claim 1, wherein said liquid developing material layer in said nip gap has a thickness of about less than 5 microns.

8. The imaging system of claim 1, wherein the liquid developing material layer exhibits a solids percentage by weight of at least approximately 20%.

9. An imaging process for effecting single-pass, multicolor printing of a color image, comprising the steps of:

providing a plurality of contact electrostatic printing engines operable in serial fashion upon a copy substrate, wherein each contact electrostatic printing engine images and develops a respective electrostatic latent image representative of a component of the color image, and subsequently transfers the developed component image to the copy substrate as the copy substrate is engaged by each contact electrostatic printing engine and proceeds in a single pass through the imaging system;

providing, in at least one of said contact electrostatic printing engines, a first movable member for having an electrostatic latent image formed thereon including image areas defined by a first voltage potential and non-image areas defined by a second voltage potential;

providing a second movable member for having a layer of liquid developing material coated thereon and developing material comprising toner particles and a liquid carrier;

forming a process nip by operative engagement of said first movable member and said second movable member, said process nip being defined by a nip entrance, a nip exit and a nip gap therebetween;

positioning the layer of liquid developing material in pressure contact with said first movable member in said process nip, wherein the electrostatic latent image on said first member generates imagewise electric fields across the layer of liquid developing material in said process nip;

imagewise developing said developing material in said nip gap to form a developed image corresponding to said image areas, and a background image corresponding to said non-image areas, said developed image and said background image each having the thickness greater than one-half the nip gap; and imagewise separating the layer of liquid developing material at said nip exit.

10. The imaging process of claim 9, wherein:

the liquid developing material comprises toner particles immersed in a liquid carrier; and the yield stress threshold of the layer of liquid developing material is sufficient to prevent lateral movement of toner particles therein in presence of the compressive stress forces exerted at the nip and nip entrance, and the yield stress threshold is sufficient to permit lateral movement of the toner particles therein in presence of the tensile stress forces exerted at the nip exit.

11. The imaging process of claim 9, wherein said step of depositing a layer of liquid developing material is adapted to deposit a layer of liquid developing material having a thickness of approximately 2 to 15 microns in said nip gap.

12. The imaging process of claim 9, wherein said step of depositing a layer of liquid developing material is adapted to deposit a layer of liquid developing material having a thickness in a range between approximately 3 and 8 microns in said nip gap.

13. The imaging process of claim 9, wherein said step of depositing a layer of liquid developing material is adapted to deposit a liquid developing material layer having a solids percentage by weight of at least approximately 20%.

14. An imaging system for effecting single-pass, multicolor printing of a color image, comprising:

a plurality of contact electrostatic printing engines operable in serial fashion upon a copy substrate, wherein each contact electrostatic printing engine includes means for imaging and developing a respective electrostatic latent image representative of a component of the color image, and means for subsequently transferring the developed component image to the copy substrate as the copy substrate is engaged by each contact electrostatic printing engine and proceeds in a single pass through the imaging system, wherein at least one of the contact electrostatic printing engines further comprises:

image bearing member to form a marking material layer thereon adjacent the electrostatic latent image on said imaging member;

a charging source for selectively delivering charges to the marking material layer in an image-wise manner responsive to the electrostatic latent image on said image bearing member to form a secondary latent image in the marking material layer having image and non-image areas corresponding to the electrostatic latent image on said imaging member; and separator member for selectively separating portions of the marking material layer in accordance with the secondary latent image in the marking material layer to create a developed image corresponding to the electrostatic latent image formed on said image bearing member.

15. The imaging system of claim 14, wherein said image bearing member includes a photosensitive imaging substrate.

16. The imaging system of claim 14, further including a liquid developing material supply apparatus adapted to deposit the layer of liquid developing material on a surface associated with said image bearing member.

17. The imaging system of claim 14, wherein said liquid developing material layer has a thickness of approximately 2 to 15 microns in the nip gap.

18. The imaging system of claim 14, wherein said liquid developing material layer in said nip gap has a thickness of about less than 5 microns.

19. The imaging system of claim 14, wherein the liquid developing material layer exhibits a solids percentage by weight of at least approximately 20%.

20. An imaging system for effecting single-pass, multicolor printing of a color image, comprising:

a plurality of contact electrostatic printing engines operable in serial fashion upon a copy substrate, wherein each contact electrostatic printing engine includes means for imaging and developing a respective electrostatic latent image representative of a component of the color image, and means for subsequently transferring the developed component image to the copy substrate as the copy substrate is engaged by each contact electrostatic printing engine and proceeds in a single pass through the imaging system, wherein at least one of the contact electrostatic printing engines further comprises:

an image bearing member for having an electrostatic latent image formed thereon, said image bearing member having a surface capable of supporting toner particles;

an imaging device for generating the electrostatic latent image on said image bearing member, wherein the electrostatic latent image includes image areas defined by a first charge voltage and non-image areas defined by a second charge voltage distinguishable from the first charge voltage;

a toner supply apparatus for depositing toner particles on the surface of said imaging member to form a toner layer thereon adjacent the electrostatic latent image on said image bearing member;

a biased member for inducing air breakdown to create an electrical discharge in the vicinity of the toner layer on the latent image on the image bearing member, wherein the electrical discharge selectively delivers charged ions to the toner layer in response to the electrostatic latent image on said image bearing member to form a secondary latent image in the toner layer having image and non-image areas corresponding to the electrostatic latent image on said image bearing member; and a separator member for selectively separating and transferring portions of the toner layer thereto in accordance with the secondary latent image in the toner layer to create a developed image corresponding to the electrostatic latent image formed on said image bearing member.

21. The imaging system of claim 20, wherein said image bearing member includes a photosensitive imaging substrate.

22. The imaging system of claim 20, further including a liquid developing material supply apparatus adapted to deposit the layer of liquid developing material on a surface associated with said image bearing member.

23. The imaging system of claim 20, wherein said liquid developing material layer has a thickness of approximately 2 to 15 microns in the nip gap.

24. The imaging system of claim 20, wherein said liquid developing material layer in said nip gap has a thickness of about less than 5 microns.

25. The imaging system of claim 20, wherein the liquid developing material layer exhibits a solids percentage by weight of at least approximately 20%.

* * * * *